US006357870B1

(12) United States Patent
Beach et al.

(10) Patent No.: US 6,357,870 B1
(45) Date of Patent: Mar. 19, 2002

(54) INTERMEDIATE TRANSFER MEDIUM COATING SOLUTION AND METHOD OF INK JET PRINTING USING COATING SOLUTION

(75) Inventors: Bradley Leonard Beach, Lexington; David Starling MacMillan, Winchester; Jean Marie Massie; Ronald Lloyd Roe, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/686,130

(22) Filed: Oct. 10, 2000

(51) Int. Cl.[7] ..... B41J 2/01
(52) U.S. Cl. ..... 347/103
(58) Field of Search ..... 347/103, 101, 347/105, 217, 139, 154; 399/154, 302, 303, 308; 106/22, 23, 31.13; 430/256; 156/247; 428/202

(56) References Cited

U.S. PATENT DOCUMENTS

| | | | | |
|---|---|---|---|---|
| 2,753,276 | A | | 7/1956 | Brochhagen et al. |
| 4,636,409 | A | | 1/1987 | Arai et al. |
| 4,643,917 | A | | 2/1987 | Koshizuka et al. |
| 4,664,952 | A | | 5/1987 | Arai et al. |
| 4,868,581 | A | | 9/1989 | Mouri et al. |
| 4,880,324 | A | | 11/1989 | Sato et al. |
| 4,903,041 | A | | 2/1990 | Light |
| 4,914,079 | A | | 4/1990 | Takei et al. |
| 4,966,464 | A | | 10/1990 | Matoushek |
| 5,017,223 | A | * | 5/1991 | Kobayashi et al. |
| 5,032,499 | A | * | 7/1991 | Kohno et al. |
| 5,168,289 | A | | 12/1992 | Katakabe et al. |
| 5,512,930 | A | | 4/1996 | Brandt et al. |
| 5,534,905 | A | | 7/1996 | Takahashi et al. |
| 5,541,636 | A | | 7/1996 | Ingram |
| 5,640,180 | A | | 6/1997 | Hale et al. |
| 5,694,160 | A | | 12/1997 | Taguchi et al. |
| 5,698,018 | A | | 12/1997 | Bishop et al. |
| 5,750,592 | A | | 5/1998 | Shinozuka et al. |
| 5,805,191 | A | | 9/1998 | Jones et al. |
| 5,808,645 | A | | 9/1998 | Reeves et al. |
| 5,886,727 | A | | 3/1999 | Dobashi et al. |
| 5,985,975 | A | | 11/1999 | Kurabayashi et al. |
| 6,196,674 | B1 | | 3/2001 | Takemoto |
| 6,218,068 | B1 | * | 4/2001 | Tanaka et al. |

* cited by examiner

*Primary Examiner*—Raquel Yvette Gordon
(74) *Attorney, Agent, or Firm*—D. Brent Lambert; Mark J. Henry

(57) ABSTRACT

A method of printing uses a liquid applicator to apply a coating solution ontaining polyvinyl pyrrolidone or a polyvinyl pyrrolidone copolymer to an intermediate transfer medium. An image is printed onto the intermediate transfer medium using an ink jet printing device. The coating solution contains an organic solvent, which is preferably a glycol solvent or a diol solvent. Suitable solvents include trimethylene glycol, diethylene glycol, propylene glycol, di propylene glycol, tri propylene glycol, 1,2 butane diol, 2 pyrrolidone, gamma butyrolactone and glycerol. The coating solution is applied in an amount of 0.01 to 10 mg/cm$^2$. The coating solution may contain 0.01 to 20 wt. % of polyvinyl pyrrolidone or a polyvinyl pyrrolidone copolymer, 5–95 wt. % of an organic solvent and 5–95 wt. % water. More preferably, the coating solution contains 0.01 to 15 wt. % of polyvinyl pyrrolidone or a polyvinyl pyrrolidone copolymer, 5–95 wt. % of an organic solvent and 5–95 wt. % water. Most preferably, the coating solution contains 2 to 8 wt. % of polyvinyl pyrrolidone or a polyvinyl pyrrolidone copolymer, 5–95 wt. % of an organic solvent and 5–95 wt. % water. The PVP should have a molecular weight greater than 400,000, more preferably greater than 750,000 and most preferably within the range of from 850,000 to 1,500,000.

28 Claims, 1 Drawing Sheet

INTERMEDIATE TRANSFER MEDIUM COATING SOLUTION AND METHOD OF INK JET PRINTING USING COATING SOLUTION

BACKGROUND OF THE INVENTION

1. Field of the Invention

The present invention relates generally to inkjet printing. More specifically, the present invention relates to inkjet printing onto an intermediate transfer medium coated with a liquid coating solution.

2. Description of the Related Art

Early inkjet printers had several distinct advantages over laser printers. They could print in color and had size and cost advantages. However, in order for the next a generation of inkjet printers to compete with laser printers in an office environment, it will be necessary to increase the printing speed and print quality. As a goal, a printing speed of 20 pages per minute is desired. For print quality, a print density of 1.4 as measured on an optical densitometer and a resolution of at least 600 dots per inch are desired.

To achieve these goals and successfully compete with laser printers in the business printer market, it has been proposed to print from an inkjet head onto an intermediate transfer surface (e.g. a drum) and then transfer the image onto a final medium (e.g. paper). Prior attempts at this intermediate transfer type printing have resulted in poor transfer efficiency, that is, the image printed onto the intermediate transfer surface did not completely transfer to the final medium. Some of the material deposited on the intermediate transfer surface remained after transfer. Prior attempts at using an intermediate transfer medium with inkjet printing have also resulted in poor optical density.

SUMMARY OF THE INVENTION

Accordingly, it is an object of the present invention to increase the speed of inkjet printing.

It is a further object of the present invention to increase the optical density of images printed by inkjet printing.

It is a still further object of the present invention to enable inkjet printing using an intermediate transfer medium in which the transfer efficiency to the final medium is increased.

These and other objects are accomplished by providing a method of printing, which uses a liquid applicator to apply a coating solution containing polyvinyl pyrrolidone or a polyvinyl pyrrolidone copolymer to an intermediate transfer medium. An image is printed onto the intermediate transfer medium using an ink jet printing device.

The coating solution contains an organic solvent, which is preferably a glycol solvent or a diol solvent. Suitable solvents include trimethylene glycol, diethylene glycol, propylene glycol, di propylene glycol, tri propylene glycol, 1,2 butane diol, 2 pyrrolidone, gamma butyrolactone and glycerol. The coating solution is applied in an amount of 0.01 to 10 mg/cm$^2$ and more preferably in an amount of 0.1 to 3 mg/cm$^2$. The coating solution may contain 0.01 to 20 wt. % of polyvinyl pyrrolidone or a polyvinyl pyrrolidone copolymer, 5–95 wt. % of an organic solvent and 5–95 wt. % water. More preferably, the coating solution contains 0.01 to 15 wt. % of polyvinyl pyrrolidone or a polyvinyl pyrrolidone copolymer, 5–95 wt. % of an organic solvent and 5–95 wt. % water. Most preferably, the coating solution contains 2 to 8 wt. % of polyvinyl pyrrolidone or a polyvinyl pyrrolidone copolymer, 5–95 wt. % of an organic solvent and 5–95 wt. % water. The PVP should have a molecular weight greater than 400,000, more preferably greater than 750,000 and most preferably within the range of from 850,000 to 1,150,000.

BRIEF DESCRIPTION OF THE DRAWINGS

The invention will be readily understood by reference to the following description of preferred embodiments described by way of example only, with reference to the accompanying drawing, wherein.

DETAILED DESCRIPTION OF THE PREFERRED EMBODIMENTS

Figure 1:
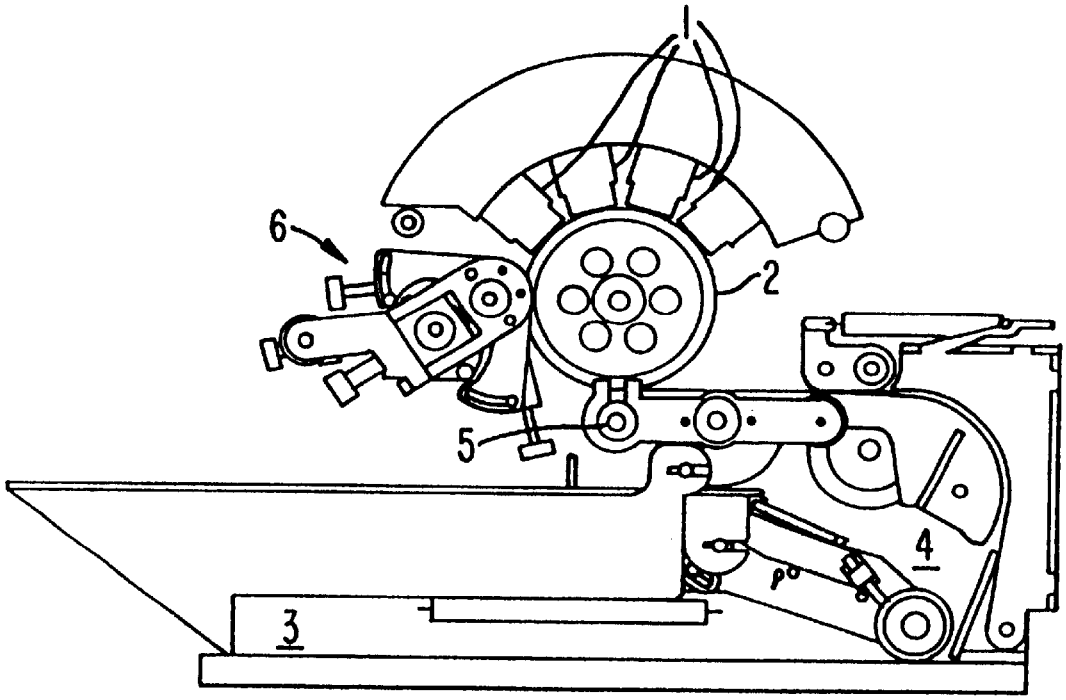
FIG. 1 is the side view of an inkjet printer according to a preferred embodiment of the present invention.

FIG. 1 is the side view of an inkjet printer according to a preferred embodiment of the present invention. One or more inkjet printheads 1 are mounted over an intermediate transfer medium 2 (shown in FIG. 1 as a drum), at a distance of lmm or less from the drum. FIG. 1 shows four printheads 1, but the invention is not so restricted. A conventional inkjet printhead can be used with the printer. The ink supplied to the printheads 1 has a relatively high amount of wetting agent.

As the inkjet printheads 1 move along the axis of the drum 2, they are printing. At the same time, drum 2 is rotating. A heater may be provided within the core of the drum 2 to heat the drum 2. The drum 2 may be made of a metal such as stainless steel or aluminum. Alternatively, the drum may have rigid core, formed of stainless steel, aluminum or other material, covered with a rubber.

The final medium (e.g. paper) is kept within cavity 3. The paper is supplied to the drum 2 from the cavity 3 with a paper feed mechanism 4. From the paper feed mechanism 4, paper is fed through a nip to bring the paper into contact with the drum 2. Specifically, a transfer roller 5 is used to bring the paper into contact with the drum 2. Roller 5 may be solid or formed of a foam urethane, silicone or other type of rubber. Great pressure is not necessary between the roller 5 and the drum 2. A pressure of 25 psi or less is sufficient.

The drum 2 may be covered with a rubber material. Polyurethane is a preferred rubber material. A liquid cast polyurethane may be used. The prepolymer of the polyurethane polymer may be cured with a polyether, a polyester type polyol or an amine based curative. Any type of rubber may be used to cover the drum, as long as the surface energy of the rubber is similar to the surface energies of a liquid drum coating solution (described below) and the ink to allow for good wetting of the rubber.

Both the ink and the liquid coating solution must sufficiently wet the drum. The liquid coating solution is applied to the drum 2 during the print process by a roll coating or other mechanism 6. The drum 2 rotates in a clockwise direction. Therefore, the coating solution from roll coating mechanism 6 is applied to the drum 2 before the drum 2 reaches the printheads 1. The liquid coating solution forms a sacrificial layer on the drum, which sacrificial layer is transferred along with the image to the paper. By forming a film on the drum, the liquid coating solution increases the transfer efficiency to the paper so that preferably all of the ink is transferred from the drum to the paper. The coating solution further prevents colored inks from bleeding into each other. With these properties, the coating solution increases optical density and improves image resolution. The coating solution should completely coat (wet) the drum. For this purpose, the coating solution and the drum should have similar surface energies. Usually, the surface energy of the drum is somewhat higher than the surface energy of the coating solution. The surface energy of the solid drum is determined based on the Young Dupré relation using the Kaelble equation of state (J. Adhesion, Vol. 2, page 66 (1970)). The surface energy of the liquid coating solution is determined using the DuNuoy Ring method.

A mixture containing polyvinyl pyrrolidone (PVP) works very well for the liquid coating solution. In the coating solution, PVP may be contained in an amount of 0.01 to 20 wt. %. More preferably, PVP is contained in an amount of 0.01 to 15 wt. %, and most preferably, PVP is contained in an amount of 2–8 wt. %. Although the molecular weight can be varied, higher molecular weights are associated with better transfer efficiency. If the molecular weight is extremely high, however, the coating solution becomes very viscous and difficult to apply to the drum. The molecular weight should be over 400,000. More preferably, the molecular weight should be over 750,000. Most preferably, the molecular weight should be within the range of 850,000 to 1,150,000.

Instead of a PVP homopolymer, a PVP copolymer can be used. A list of suitable PVP copolymers includes copolymers with vinyl acetate, dimethyl aminopropyl methacrylamide, dimethyl amino ethyl methacrylate, quaternized dimethyl amino ethyl methacrylate, and methacryl amido propyl trimethyl ammonium chloride.

Aside from PVP, the liquid coating solution may also contain an organic solvent and water. The liquid coating solution may contain 5–95 wt. % organic solvent and preferably 50–95 wt. % organic solvent. Diols, glycols and other organic solvents work well as the organic solvent. Diols, glycols and other organic solvents work well as the organic solvent. Suitable solvents include propylene glycol, 1,2 butane diol, glycerol, trimethylene glycol, diethylene glycol, di propylene glycol, tripropylene glycol, gamma-butyrolactone and 2 pyrrolidone.

The water used for the liquid coating solution is preferably deionized water. The coating solution may contain 5–90 wt. % water and preferably 5–50 wt. % water.

The liquid coating solution may also contain a flocculating agent, a reagent added to a dispersion of solids in a liquid to bring together fine particles to form "flocs." These flocs are small masses formed in the liquid through coagulation or agglomeration of fine suspended particles. The ink is supplied as a dispersion of solid pigment particles. The flocculating agent or "flocculant" counterfacts the effect of the ink dispersant. The flocculant therefore causes the pigment to come out of solution and clump together. Once the ink is on the drum or the paper, the flocculant stabilizes the pigment particles to prevent the pigment particles from moving. The flocculant fixes the particles to ensure good print quality.

As mentioned previously, a heater may be provided within the core of the drum 2 to heat the drum 2. When the drum 2 is heated, the liquid within the ink is evaporated, thereby fixing the pigment onto the drum. By forcing the pigment particles out of solution, the flocculant achieves the same goal as the heater. Thus, if the liquid coating solution contains a flocculating agent, it is not necessary to provide a heater within the core of the drum 2.

If a flocculant is to be used, the liquid coating solution may contain 0.1 wt. % to 10 wt. % of the flocculant. More preferably, the liquid coating solution may contain 0.5 wt. % to 5 wt. % of the flocculant. Suitable flocculating agents include acids and salts. Suitable acids include carboxylic acids such as citric, glycolic, tartaric, 1,2,3,4-butane tetracarboxylic, glutaric, succinic, lactic, and adipic acids. Suitable salts include $CaCl_2$, $AlCl_3$, and magnesium salicylate tetrahydrate.

In addition to the foregoing components, it is advantageous for the liquid coating solution to contain substantially no fluorocarbon surfactants. These additives reduce the surface energy of the coating too much and give poor wetting of the drum.

The drum coating solution is applied to the drum in an amount of 0.01 to 10 mg/cm$^2$ and more preferably in an amount of 0.01 to 3 mg/cm$^2$. The drum coating solution can be applied with a wick, felt pad, 3 roll coating system, foam roller or other method. Again, the drum coating solution should wet the entire printing surface of the drum.

As mentioned previously, the ink used for inkjet printing should contain a relatively high amount of wetting agent. Specifically, the ink should contain 0.1 to 15 wt. % wetting agent. More preferably, the ink should contain 1–5 wt. % wetting agent. Most preferably, the ink should contain 2.5–3.5 wt. % wetting agent. The purpose of the wetting agent is to ensure that a good image is formed. Diols and diethers may be used as the wetting agent. For diols, 1,2 alkyl diols having 4–10 carbon atoms are appropriate. 1,2 hexanediol has been found to work particularly well. For diethers, diether alcohols having 6–14 carbon atoms are appropriate. Hexylcarbitol has been found to work particularly well. Comparing diols and diethers, if a diether is used, less wetting agent may be required. For example, 0.01 to 2.5 wt. % diether could produce the same good results as 1.0 to 5.0 wt. % diol.

The ink used with the present invention employs organic or inorganic pigments as the colorants. The term "pigment" as used herein means an insoluble colorant formed of small pigment particles. The present invention is not restricted to the type of pigment. Pigments such as azo pigments, polycyclic pigments, perylene pigments, anthraquinone pigments, quinacridone pigments, dioxazine pigments, thioindigo pigments, isoindolinone pigments, quinophthalone pigments, nitro pigments, nitroso pigments, aniline black and daylight fluorescent pigments can be used with the invention. Titanium oxide, iron oxide and carbon black are specific pigments known to work well.

Because the pigment is insoluble, it is generally stabilized in a dispersion. The pigment/dispersion mixture is used as a pigment concentrate (also referred to as a "pigment premix") in forming the ink. U.S. Pat. Nos. 5,714,538 and 5,719,204 describe a terpolymer pigment dispersant suitable for use with the present invention. Both of these references are incorporated herein by reference. The pigment/dispersion concentrate (pigment premix) may contain from about 0.5 to about 10% by wt. pigment and 0.25% to 10% by wt. terpolymer dispersant in an aqueous carrier.

In addition to the pigment premix and the wetting agent, the ink also contains a binder, one or more humectants, a biocide, and water. The ink may or may not contain other ingredients such as chelating agents, buffers, surfactants, surface tension modifier, etc. Conventional humectants can be used to absorb or retain moisture. For the biocide, Proxel® GXL, commercially available from Zeneca, Inc. (now "Avecia, Inc."), may be used. Proxel® GXL contains 1,2 benzisothiazolin-3-one as the active ingredient and also contains dipropylene glycol and water.

The surface energy of the ink should be slightly lower than that of the coating solution. The wetting agent of the ink and the drum coating solution are chosen to achieve this goal. The surface energies of the ink and the drum coating solution should differ by no more than 10 dynes/cm. Preferably, the surface energy of the ink should be 2–9 dynes/cm less than the surface energy of drum coating solution.

EXAMPLES

1. Example One

A black pigmented ink containing 3 wt. % hexanediol was applied to a rotating drum using an inkjet printhead. The surface of the drum was formed of a Adiprene L42™ (Uniroyal Chemical) cured with polyether polyol Simusol TOIE™ (Seppic). The drum was heated to a temperature of 30° C. and rotated at a speed of 15.1 in/sec. While rotating, a drum coating solution including 5 wt. % PVP K90™ (ISP), 60 wt. % propylene glycol, and 35 wt. % deionized water was applied to the drum. The image was transferred from the drum to paper. A silicone foam roller with a hardness of 45 Asker C (500 g) was used as the transfer roll. The system described above produced a black image having an optical density of 1.4. The resolution of the image was 600 dots per inch. 20 pages per minute are envisioned by the system.

2. Example Two

A pigmented black ink containing 4 wt. % hexanediol was applied to a rotating drum using an inkjet printhead. The surface of the drum was formed of Adiprene L42™ (Uniroyal Chemical) cured with polyether plyol Simusol TOIE™ (Seppic). The drum was heated to a temperature of 30° C. and rotated at a speed of 15.1 in/sec. While rotating, a drum coating solution including 5 wt. % PVP K120™ (ISP), 50 wt. % tripropylene glycol and 45 wt. % deionized water was applied to the drum. The image was transferred from the drum to paper. An aluminum transfer roll was used as the transfer roll. The system described above produced a black image having an optical density of 1.4. The resolution of the image was 600 dots per inch. A transfer efficiency of 100% of the ink was attained.

3. Example Three

A pigmented black ink containing 4 wt. % hexanediol was applied to a rotating drum using an inkjet printhead. The surface of the drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution including 5 wt. % PVP K120™ (ISP), 75 wt. % 1,2 propane diol and 20 wt. % deionized water was applied to the drum. The image was transferred from the drum to paper. An aluminum transfer roll was used as the transfer roll. The system described above produced a black image having an optical density of 1.4. The resolution of the image was 600 dots per inch. A transfer efficiency of 100% of the ink was attained.

4. Example Four

A pigmented black ink containing 4 wt. % hexanediol was applied to a rotating drum using an inkjet printhead. The surface of the drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution including 5 wt. % PVP copolymer, Copolymer 845™ (ISP) (supplied as 20 wt. % of the copolymer in water), 50 wt. % tripropylene glycol and 45 wt. % deionized water was applied to the drum. The image was transferred from the drum to paper. An aluminum transfer roll was used as the roll. The system described above produced a black image having an optical density of 1.4. The resolution of the image was 600 dots per inch. A transfer efficiency of 100% of the ink was attained.

5. Example Five

A pigmented black ink containing 3 wt. % hexanediol was applied to a rotating drum using an inkjet printhead. The surface of the drum was formed of Adiprene L42™ (Uniroyal Chemical) cured with polyether plyol Simusol TOIE™ (Seppic). The drum was heated to a temperature of 50° C. and rotated at a speed of 15.1 in/sec. While rotating, a drum coating solution containing 3 wt. % PVP K90™ (ISP), 77 wt. % 1,2 propane diol and 20 wt. % deionized water was applied to the drum. The image was transferred from the drum to paper. An aluminum transfer roll was used as the transfer roll. The system described above produced a black image having an optical density of 1.4. The resolution of the image was 600 dots per inch. A transfer efficiency of 100% of the ink was attained.

6. Example Six

A black, cyan, yellow or magenta pigmented black ink containing 3 wt. % hexanediol was applied to a rotating drum using an inkjet printhead. The surface of the drum was formed of a Adiprene L42™ (Uniroyal Chemical) cured with polyether polyol Simusol TOIE™ (Seppic). The drum was not heated. However, the drum was rotated at a speed of 15.1 in/sec. While rotating, a drum coating solution including 5 wt. % PVP K90™ (ISP), 5 wt. % citric acid flocculating agent, 40 wt. % tripropylene glycol, 30 wt. % propylene glycol and 20 wt. % deionized water, was applied to the drum. The image was transferred from the drum to paper. A PFA sleeved silicone foam was used as a transfer roller. The system described above did not require for the drum to be heated and produced an image having good optical density and resolution.

While the invention has been described in connection with the preferred embodiments, it will be understood that modifications within the principles outlined above will be evident to those skilled in the art.

What is claimed is:

1. A method of printing comprising the steps of:

applying a coating solution containing polyvinyl pyrrolidone or a polyvinyl pyrrolidone copolymer to an intermediate transfer medium;

printing an image onto the intermediate transfer medium using an ink jet printing device; and transferring the image to final medium.

2. A method of printing according to claim 1, wherein the coating solution contains an organic solvent.

3. A method of printing according to claim 1, wherein the coating solution contains an organic solvent selected from the group consisting of glycol solvents and diol solvents.

4. A method of printing according to claim 1, wherein the coating solution contains a solvent selected from the group consisting of trimethylene glycol, diethylene glycol, propylene glycol, di propylene glycol, tri propylene glycol, 1,2 butane diol, 2 pyrrolidone, gamma butyrolactone and glycerol.

5. A method of printing according to claim 1, wherein the coating solution is applied in an amount of 0.01 to 10 $mg/cm^2$.

6. A method of printing according to claim 1, wherein the coating solution contains 0.01 to 20 wt. % of polyvinyl pyrrolidone or a polyvinyl pyrrolidone copolymer.

7. A method of printing according to claim 6, wherein the coating solution further contains 50–95 wt. .% of an organic solvent and 5–50 wt. % water.

8. A method of printing according to claim 1, wherein the coating solution contains 0.01 to 15 wt. % of polyvinyl pyrrolidone or a polyvinyl pyrrolidone copolymer.

9. A method of printing according to claim 8, wherein the coating solution further contains 50–95 wt. % of an organic solvent and 5–50 wt. % water.

10. A method of printing according to claim 1, wherein the coating solution contains 2 to 8 wt. % of polyvinyl pyrrolidone or a polyvinyl pyrrolidone copolymer.

11. A method of printing according to claim 10, wherein the coating solution further contains 50–95 wt. % of an organic solvent and 5–50 wt. % water.

12. A method of printing according to claim 1, wherein the polyvinyl pyrrolidone or the polyvinyl pyrrolidone copolymer has a molecular weight greater than 400,000.

13. A method of printing according to claim 1, wherein the polyvinyl pyrrolidone or the polyvinyl pyrrolidone copolymer has a molecular weight greater than 750,000.

14. A method of printing according to claim 1, wherein the polyvinyl pyrrolidone or the polyvinyl pyrrolidone copolymer has a molecular weight within the range of from 850,000 to 1,500,000.

15. An intermediate transfer medium coating solution for inkjet printing, comprising:

0.01 to 20 wt. % of polyvinyl pyrrolidone or a polyvinyl pyrrolidone copolymer;

5–95 wt. % of a solvent selected from the group consisting of glycol solvents and diol solvents; and 5–95 wt. % water.

16. A coating solution according to claim 15, wherein the coating solution contains 50–95 wt. % solvent and 5–50 wt. % water.

17. A coating solution according to claim 15, wherein the solvent is selected from the group consisting of trimethylene glycol, diethylene glycol, propylene glycol, di propylene glycol, tri propylene glycol, 1,2 butane diol, 2 pyrrolidone, gamma butyrolactone and glycerol.

18. A coating solution according to claim 15, wherein the coating solution contains 0.01 to 15 wt. % of polyvinyl pyrrolidone or a polyvinyl pyrrolidone copolymer.

19. A coating solution according to claim 15, wherein the coating solution contains 2 to 8 wt. % of polyvinyl pyrrolidone or a polyvinyl pyrrolidone copolymer.

20. A coating solution according to claim 15, wherein the polyvinyl pyrrolidone or the polyvinyl pyrrolidone copolymer has a molecular weight greater than 400,000.

21. A coating solution according to claim 15, wherein the polyvinyl pyrrolidone or the polyvinyl pyrrolidone copolymer has a molecular weight greater than 750,000.

22. A coating solution according to claim 15, wherein the polyvinyl pyrrolidone or the polyvinyl pyrrolidone copolymer has a molecular weight within the range of from 850,000 to 1,500,000.

23. A coating solution according to claim 15, further comprising a flocculating agent.

24. A coating solution according to claim 15, wherein the coating solution ontains 0.1 wt. % to 10 wt. % flocculating agent.

25. An intermediate transfer medium coating solution for inkjet printing, comprising:

0.01 to 20 wt. % of polyvinyl pyrrolidone or a polyvinyl pyrrolidone copolymer;

5–95 wt. % of a solvent selected from the group consisting of glycol solvents and diol solvents;

5–95 wt. % water; and 0.1–10 w t.% flocculating agent.

26. A coating solution according to claim 25, wherein the coating solution contains 0.5 to 5.0 wt. % flocculating agent.

27. A coating solution according to claim 25, wherein the flocculating agent is selected from the group consisting of multivalent acids and salts.

28. A coating solution according to claim 25, wherein the flocculating agent is selected from the group consisting of citric acid, glycolic acid, tartaric acid, 1,2,3,4-butane tetracarboxylic acid, glutaric acid, succinic acid, lactic acid, adipic acid, $CaCl_2$, $AlCl_3$ and magnesium salicylate tetrahydrate.

* * * * *